United States Patent [19]

Cufr

[11] Patent Number: 5,005,387

[45] Date of Patent: Apr. 9, 1991

[54] CABINET LOCKING DEVICE

[75] Inventor: Robert J. Cufr, Swanton, Ohio

[73] Assignee: Meilink Industries, Inc., Whitehouse, Ohio

[21] Appl. No.: 616,215

[22] Filed: Nov. 20, 1990

[51] Int. Cl.[5] ..... E05B 65/46

[52] U.S. Cl. ..... 70/86; 70/81

[58] Field of Search ..... 70/81, 86, 85, 84, 100, 70/82; 312/215, 219, 333

[56] References Cited

U.S. PATENT DOCUMENTS

| | | | |
|---|---|---|---|
| 186,192 | 1/1877 | Baker | 70/86 |
| 221,464 | 11/1879 | Huff | 70/86 |
| 276,516 | 4/1883 | Whitney | 70/86 |
| 2,440,541 | 4/1948 | Gash | 70/86 |
| 4,235,492 | 11/1980 | Conger | 70/85 |

*Primary Examiner*—Robert L. Wolfe

*Attorney, Agent, or Firm*—Marshall & Melhorn

[57] ABSTRACT

A locking device for simultaneously locking two adjacent file cabinet drawers in a cabinet housing includes a locking mechanism mounted on a front face of one drawer. When a key is turned to actuate the locking mechanism, a cam, attached to the locking mechanism and positioned generally horizontally in a chamber formed in the first drawer, is rotated through a slot formed in a wall of the first drawer. Continued rotation of the locking mechanism rotates the cam through a slot formed in a mullion provided between the first drawer and an adjacent second drawer and into a slot formed in the second drawer to a generally vertical position for the cam. A central portion of the cam cooperates with the mullion and an end portion of the cam cooperates with the slot in the second drawer to prevent movement of the two drawers in the housing.

12 Claims, 1 Drawing Sheet

CABINET LOCKING DEVICE

BACKGROUND OF THE INVENTION

This invention relates generally to a cabinet locking device. More particularly, the invention relates to a locking device for securing two file cabinet drawers within a file cabinet housing.

Office file cabinets typically include multiple drawers which are secured by some sort of locking device. Many of these locking devices are exceedingly complex and costly to manufacture.

U.S. Pat. No. 311,898 discloses a locking mechanism for locking two cabinets together whereby the locking mechanism consists of a bolt pivotally attached inside a mullion between two drawers. When the locking mechanism is to be engaged, the bolt is rotated and the distal ends of the bolt enter into slots located in the bottom of the upper drawer and the top of the lower drawer, thereby preventing the drawers from being opened.

U.S. Pat. No. 4,235,492 discloses a locking device, intended for use with vehicular audio equipment, in which a key-operated lock is mounted inside the dashboard between two units of audio equipment. A securing arm is rotatably affixed to the lock behind the dashboard so that, when rotated by a key, the distal ends of the securing arm extend through slots in the bottom of the upper audio unit and the top of the lower audio unit and hook onto a pin in each audio unit, whereby the securing arm prevents removal of the unit housings from the dashboard.

U.S. Pat. No. 3,511,549 discloses a gang lock for locking a plurality of drawers, the lock having a lock bar provided with a plurality of hooks and extending vertically inside a cabinet housing. Means are provided for shifting the lock bar so that, when activated, the hooks engage a portion of each drawer, and when deactivated, the hooks disengage from the drawers so that they can be opened.

When employing locking devices such as those disclosed above to secure file cabinet drawers, a potential problem stems from the fact that the bolt or arms of the locking device must extend simultaneously into the slots formed in the drawers. Therefore, the slot in each drawer and the corresponding end of the bolt or the arm must be simultaneously aligned so that when the locking device is turned, the distal end of the bolt or the arm will enter the slot in each drawer.

As units grow old and receive normal wear and tear from everyday use, the drawers can become misaligned or the locking device can bend slightly, etc., making it difficult to simultaneously align the slots in each drawer with the locking device. These difficulties may be overcome temporarily by jiggling the misaligned drawer until the misaligned slot properly aligns with the bolt end or the arm. However, because the bolt ends or arms of the locking device must extend into the slot of each drawer simultaneously, and the entire locking device mechanism is concealed within the housing of the cabinet, it is difficult to determine whether misalignment is due to a bent drawer slot, a bent locking device, or some combination thereof. In addition, if the locking device requires repair, at least one of the drawers must be completely removed from the cabinet housing to gain access to the locking device mechanism.

SUMMARY OF THE INVENTION

One objective of the invention is to produce a simple. inexpensive locking device for simultaneously locking two file cabinet drawers without interfering in the operation of other drawers in the cabinet.

Another objective of the invention is to produce a locking device for locking two drawers in a cabinet, whereby as a locking mechanism is turned, it engages first one drawer and then the other, so that if one of the drawers is misaligned, such condition will be apparent as the lock is operated.

In accordance with the present invention for simultaneously locking two file cabinet drawers, a locking device has a locking mechanism disposed within the front face or door of one drawer. The locking mechanism receives a key such that, when the key is turned to activate the locking mechanism, a securing cam attached to the locking mechanism first extends through a slot in the lock retaining door. As the locking mechanism is further rotated, the cam extends through a slot in a mullion provided between the two drawers, and then into a slot provided in a door of an adjacent lock receiving drawer, thereby securing the two drawers to the mullion and preventing movement of the two drawers from the locked position in the file cabinet.

BRIEF DESCRIPTION OF THE DRAWINGS

Other objects and advantages of the invention will become readily apparent to those skilled in the art from reading the following detailed description of an embodiment of the invention when considered in the light of the accompanying drawings, in which.

DESCRIPTION OF THE PREFERRED EMBODIMENT

Figure 1:
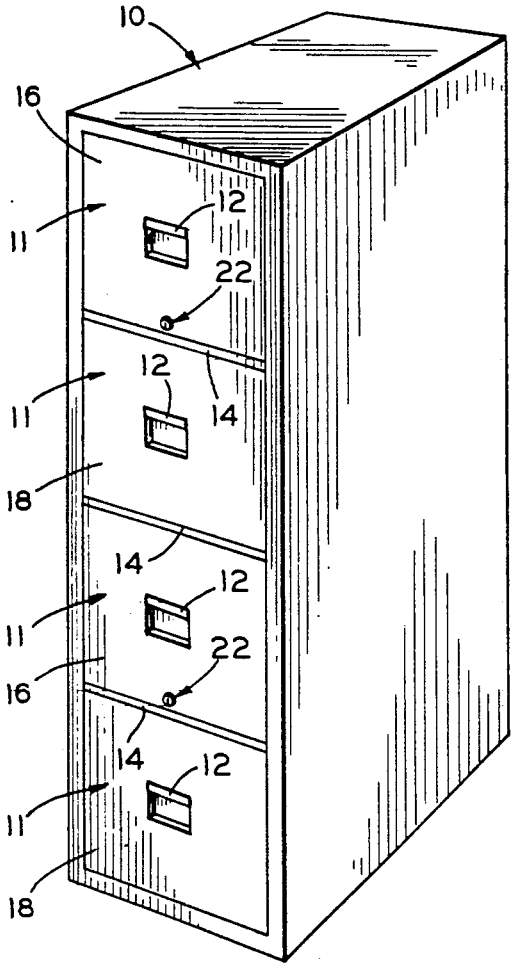
FIG. 1 is a perspective view of a four drawer file cabinet including two locking devices in accordance with the present invention.

Referring to the drawings and to FIG. 1, in particular, a file cabinet is illustrated having two locking devices in accordance with the present invention. The cabinet shown has a housing 10 and is provided with four vertically spaced openings in a front surface thereof. Each opening receives a drawer 11 which is mounted on a conventional slide mechanism (not shown) for moving in and out of the housing 10, typically by grasping a handle 12 attached to a front face or door of the drawer. The housing includes a plurality of support moldings, or mullions 14, which horizontally extend between adjacent ones of the drawers 11. A four drawer file cabinet having two locking devices in accordance with the present invention has two pairs of cooperating drawers 11, each pair including a drawer with a lock retaining front door 16 and a drawer with a lock receiving door 18.

Figure 3:
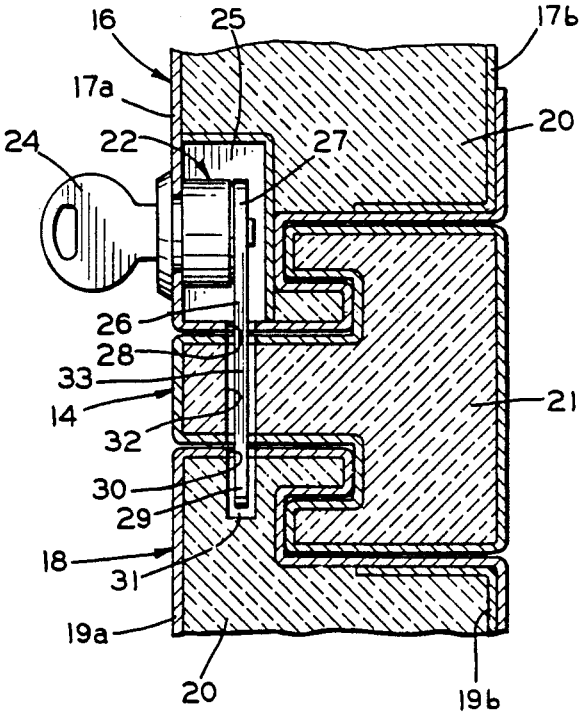
FIG. 3 is an enlarged fragmentary elevational side view of the locking device illustrated in FIG. 2 taken along the line 3—3.

The cabinet housing 10 and the drawers 11 can be insulated as best shown in FIG. 3. For example, each of the doors 16 can be formed with an outer wall 17*a* spaced from an inner wall 17*b*. Similarly, the doors 18 can be formed with an outer wall 19*a* spaced from an inner wall 19*b*. The spaces between the walls 17*a* and 17*b* and the walls 19*a* and 19*b* can be filled with an insulating material 20. The mullion 14 also can be formed with a hollow interior which can be filled with an insulating material 21 and is representative of the construction of the walls of the housing 10. However, the insulation 20 and 21 is not required to practice the present invention.

A locking mechanism 22 is located within each of the doors 16 at a lower central position. An exteriorly exposed end portion of the locking mechanism has a keyhole for accommodating a key 24 for actuating the locking mechanism. The locking mechanism 22 is mounted on and extends through the outer wall 17*a* into a chamber 25 formed inside the door 16 and void of the insulating material 20. An elongated cam 26 has one end 27 attached to an interior end portion of the locking mechanism for rotation about the point of attachment in response to a turning of the key 24.

Figure 2:
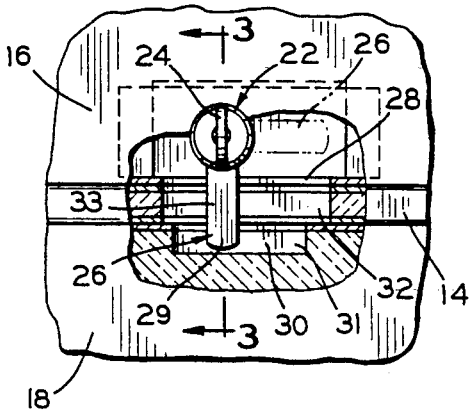
FIG. 2 is an enlarged fragmentary front elevational view of one of the locking devices shown in FIG. 1 with portions broken away for clarity.

In the locked position, as shown in FIGS. 2 and 3, the cam 26 extends downwardly through a slot 28 formed in a bottom portion of the outer wall 17*a* adjacent the mullion 14 An opposite end 29 of the cam 26 extends into a slot 30 formed in an upper portion of the outer wall 19*a* of the door 18 and into a chamber 31 formed in the insulating material 20. A third slot 32 is formed through the mullion 14, from an upper surface adjacent the door 16 to a lower surface adjacent the door 18, and is aligned with the slots 28 and 30 to receive a central portion 33 of the cam 26.

In operation, the cam 26 is rotated, utilizing the key 24, to the generally horizontal unlocked position shown in phantom in FIG. 2 so that the drawers 11 are free to move out of and into the housing 10. When the adjacent pair of drawers 11 having the doors 16 and 18 is closed, the slots 28, 30 and 32 are vertically aligned as shown in FIG. 3. The key 24 can be inserted into the locking mechanism 22 and rotated in a clockwise direction, FIG. 2, to rotate the cam 26 to a locked position as illustrated in FIGS. 2 and 3. As the key 24 is turned, the cam 26 rotates from the position shown in phantom through the slot 28 which can be asymmetrical in a horizontal plane to clear the end 29 of the cam. The cam 26 then enters the slot 32 in the mullion 14 between the two drawers 16 and 18 and continues downwardly into the slot 30 in the lock receiving door 18. Similarly, the slots 30 and 32 can be asymmetrical in the horizontal plane to clear the end 29 of the cam 26. In the locked position, the cam 26 extends generally vertically and prevents movement of either of the two drawers 11 having the doors 16 and 18 with respect to the file cabinet housing 10.

The locking mechanism according to the present invention also indicates misalignment of the drawers with respect to the housing 10. If the door 16 is misaligned, the end 29 of the cam 26 is prevented from entering the slot 32 in the mullion 14 during an initial or first portion of the rotation of the locking mechanism 22. If the door 18 is misaligned, the end 29 of the cam 26 is prevented from entering the slot 30 in the outer wall 19*a* during a latter or second portion of the rotation of the locking mechanism 22. Thus, the locking mechanism 22 indicates which drawer is misaligned.

The doors 16 and 18 and the mullion 14 are provided with generally horizontally extending cooperating flanges as shown in FIG. 3. However, the construction shown is not essential to the operation of the present invention. With respect to the lock retaining door 16, the wall 17*a* could be terminated at a lower front edge eliminating the rearwardly extending portion thereof and eliminating the wall 17*b* and the associated insulating material 20. The insulating material 21 and all but the front portion of the mullion 14 could be eliminated. With respect to the lock receiving door 18, the wall 19*a* could be terminated behind the slot 30 eliminating the rearwardly extending portion thereof and eliminating the wall 19*b* and the associated insulating material 20. In such a configuration, when the cam is in the locked position, the front portion of the mullion 14 will abut and cooperate with the central portion 33 of the cam to prevent the upper drawer from moving with respect to the housing. The portion of the wall 19*a* behind the slot 30 will abut and cooperate with the end 29 of the cam to prevent the lower drawer from moving with respect to the housing. Of course, the locking mechanism 22, the chamber 25 and the slot 28 could be located in the upper portion of the door 18 and the slot 30 and the chamber 31 could be formed in the adjacent bottom portion of the door 16.

The locking device according to the present invention is housed solely within the lock retaining door 16 and provides a means for interlocking two drawers together in a file cabinet. A locking mechanism 22 is attached to a rotatable cam means 26 which extends through and cooperates with cam receiving means such as the slots 28, 30 and 32. The cam 26 cooperates with the slot 32 in the mullion 14 to prevent movement of the drawer having the door 16 with respect to the housing 10 and cooperates with the slot 30 in the door 18 to prevent movement of the drawer having the door 18 with respect to the housing 10.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A locking device for a cabinet having a housing with at least a first and a second drawer slidable into and out of the housing and a mullion attached to the housing and positioned between the first and second drawers, the locking device comprising: a rotatable locking means mounted on a first drawer, a cam means having one end attached to said locking means and cam receiving means formed on the second drawer and a mullion, positioned between the drawers and attached to cabinet housing for the drawers, whereby when said locking means is in an unlocked position, said cam means is completely disposed in the first drawer and the drawers are free to move into and out of the cabinet housing and when said locking means is rotated to a locked position, said cam means engages said cam receiving means thereby locking and preventing movement of the drawers in the cabinet housing.

2. The locking device of claim 1 wherein said cam receiving means includes a wall of the mullion having a slot formed therethrough for receiving an opposite end of said cam.

3. The locking device of claim 2 wherein said slot is asymmetrical in a horizontal plane with respect to a position of said locking means on the first drawer.

4. The locking device of claim 1 wherein said cam receiving means includes a wall of the second drawer having a slot formed therethrough for receiving an opposite end of said cam.

5. The locking device of claim 4 wherein said slot is asymmetrical in a horizontal plane with respect to a position of said locking means on the first drawer.

6. The locking device of claim 1 wherein said rotatable locking means includes a key actuated locking mechanism mounted in a front wall of the first drawer and extending into a chamber formed behind the front wall, the chamber being asymmetrical in a horizontal plane with respect to a position of said locking mechanism on the front wall.

7. A locking device for a cabinet having a housing with at least a first and second drawer slidable into and out of the housing and a mullion attached to the housing and positioned between the first and second drawers, the locking device comprising:

a rotatable locking means mounted on a first drawer;

a cam means having one end attached to said locking means; and a cam receiving means formed on a second drawer adjacent to and separated from the first drawer by a mullion attached to a cabinet housing for the drawers whereby when said locking means is in an unlocked position, said cam means is completely disposed in the first drawer and the drawers are free to move into and out of the cabinet housing and when said locking means is rotated to a locked position, said cam means engages the mullion thereby locking and preventing movement of the first drawer in the cabinet housing and said cam means engages said cam receiving means thereby locking and preventing movement of the second drawer in the cabinet housing.

8. The locking device of claim 7 wherein said rotatable locking means includes a key actuated locking mechanism mounted in a front wall of the first drawer and extending into a chamber formed behind the front wall.

9. The locking device of claim 8 wherein a wall of the mullion has a slot formed therethrough for receiving a central portion of said cam.

10. The locking device of claim 9 wherein said cam receiving means includes a wall of the second drawer having a slot formed therethrough for receiving an opposite end of said cam.

11. The locking device of claim 10 wherein the chamber, the slot formed in a wall of the mullion and the slot formed in a wall of the second drawer are each asymmetrical in a horizontal plane with respect to a position of said locking mechanism on the front wall of the first drawer.

12. A locking cabinet comprising:

a housing with an opening for at least two drawers;

at least a first drawer and a second drawer slidable into and out of said housing;

a mullion attached to the housing and positioned between said first and second drawers;

a rotatable locking means mounted on said first drawer;

a cam means having one end attached to said locking means; and a cam receiving means formed on said second drawer whereby when said locking means is in an unlocked position, said cam means is completely disposed in said first drawer and said first and second drawers are free to move into and out of said housing and when said locking means is rotated to a locked position, said cam means engages said cam receiving means thereby locking and preventing movement of said drawers in said cabinet housing.

* * * * *